United States Patent [19]

Scharton et al.

[11] 4,320,528

[45] Mar. 16, 1982

[54] ULTRASONIC CLEANER

[75] Inventors: Terry D. Scharton, Santa Monica; G. Bruce Taylor, Culver City, both of Calif.

[73] Assignee: Anco Engineers, Inc., Culver City, Calif.

[21] Appl. No.: 114,616

[22] Filed: Jan. 23, 1980

[51] Int. Cl.[3] ..... G21C 19/32

[52] U.S. Cl. ..... 376/310

[58] Field of Search ..... 176/37; 165/95, 84; 122/380; 134/1-3; 376/310

[56] References Cited

U.S. PATENT DOCUMENTS

| | | | |
|---|---|---|---|
| 2,664,274 | 12/1953 | Worn et al. | 165/95 |
| 2,987,068 | 6/1961 | Branson | 134/1 |
| 3,033,710 | 5/1962 | Hightower et al. | 134/1 |
| 3,240,963 | 3/1966 | Sasaki et al. | 134/1 |
| 3,295,596 | 1/1967 | Ostrofsky et al. | 165/84 |
| 3,433,669 | 3/1969 | Kouril | 134/1 |
| 3,438,811 | 4/1969 | Harriman et al. | 134/2 |
| 3,447,965 | 6/1969 | Teumac et al. | 134/2 |
| 3,854,996 | 12/1974 | Frost et al. | 134/3 |
| 4,120,699 | 10/1978 | Kennedy et al. | 134/1 |
| 4,167,424 | 9/1979 | Jubenville et al. | 134/1 |

OTHER PUBLICATIONS

Chemical Cleaning of BWR and Steam Water System at Dresden Nuc. Pow. Station, Obrecht et al., pp. 1-18, (10/26/60) 21st Ann. Conf. of Eng.

*Special Tech. Pub.* 42 (1962) ASTM Role of Cavitation in Sonic Energy Cleaning, Bulat.

*Primary Examiner*—Sal Cangialosi

*Attorney, Agent, or Firm*—Thomas I. Rozsa

[57] ABSTRACT

The present invention relates to methods and apparatus for cleaning and removing the buildup of products of corrosion, oxidation, sedimentation and comparable chemical reactions from various portions of heat exchanger systems such as the location wherein the primary heat exchanger tubes come in contact with support plates for those tubes, and the base of said heat exchanger. The corrosive scale, oxides and other materials can cause denting of the primary heat exchanger tubes due to the compressive force of the oxides, scale, and other materials, and therefore adversely affects the heat exchanging ability of the heat exchanger system.

15 Claims, 11 Drawing Figures

ULTRASONIC CLEANER

BACKGROUND OF THE INVENTION

Large scale heat exchanger systems are essentially comprised of a primary system which contains a large number of individual tubes which have fluid circulating through them, and a secondary system which consists of a second fluid surrounding said tubes contained within a housing which enwraps both systems. In large scale heat exchanger systems, and especially in heat exchanger systems utilized in nuclear reactors, an often recognized problem has been the loss of efficiency of the heat exchanger system due to the build-up of products of corrosion, oxidation, sedimentation and comparable chemical reations on the inner walls of the tubes comprising the primary circulation system. More recently, it has been discovered that the secondary system is also plagued with similar problems such as the build-up of scale, oxides and similar products of corrosion on the outer walls of the tubes comprising the primary circulation system and in particular between the tubes and the support structure for the tubes. Solutions to this problem which are relatively non-destructive to the heat exchanger are desired.

Ever since nuclear reactors have been employed for the generation of electrical power, concern has been focused upon the primary heat exchanger system and on the necessity for maintaining the tubes and conduits of the primary circulation system therein free of anything that could adversely affect either the heat exchanging capability of said tubing or the unimpeded flow of fluid through said tubing. At the same time, it was recognized that to a lesser extent, the same concerns affected the secondary system.

In very large sized heat exchangers, and especially those used in conjunction with steam generating nuclear reactors, the primary system usually comprises a large number of individual tubes which have a primary fluid circulated through them. These tubes are placed in a large receptacle containing a secondary fluid. The primary fluid which carries the heat is circulated through the primary tubes in order to transfer the heat to the secondary fluid which is circulated through the receptacle. To maximize the surface available for heat exchange, the primary tube system contains a very very large number of tubes which are bundled spaced apart from each other.

Each of the large number of tubes in said primary system has a relatively small diameter. A principal concern in such systems has been the possibility of occluding and/or restricting the flow of fluid through these relatively small diameter tubes. It is also recognized that any build-up on the interior walls of the conduits or tubes adversely affects the heat exchange properties of the primary system.

In the past, similar concerns have not been directed to the secondary system which, in many cases, is the steam generation system. Therefore, in the secondary system, the principal concerns have been only that there be an adequate supply of fluid in the primary system, and that the opportunity and volume for the generation of steam is made available.

The problem of maintaining the unimpeded flow of fluid through the large number of tubes in the primary system and the efficiency of heat exchange capability of these primary system tubes is one to which a great deal of effort has been devoted. A chemical cleaning process for an entire nuclear power station was described in detail in a paper presented at the 21st Annual Water Conference of the Engineers' Society of Western Pennsylvania on Oct. 26, 1960, by M. F. Obrecht, et al, entitled "Chemical Cleaning of Boiling Water Reactor and Steam Water System at the Dresden Nuclear Power Station."

In recent years, however, a hitherto unknown but disturbing phenomena has been encountered, especially in heat exchange systems of some of the larger nuclear reactors. These utilize tube bundles in the primary system which are retained in alignment by spacer grids and support plates.

In many such systems, the tubing in the primary system was made of a relatively corrosion resistant material such as Inconel. The support structure for the tubing, however, was made of steel. In the elevated temperatures and the less than ideal fluid environment of the heat exchanger, in addition to the normal build-up of scale and other corrosion or oxidation products on the surface of the various components, it has been discovered that the steel support structure, itself, oxidized to magnetite, especially in the areas immediately adjacent the tubing in the primary system.

The support structure is comprised of spacer grids and support plates. The steel support plates, which in many heat exchanger designs are located in the upper portion of the tube bundles, are fabricated with a plurality of perforations or apertures, each to accomodate a tube of the tube bundle and to maintain the tubes adequately spaced and aligned in the secondary chamber during the installation process. Once the tube bundle was fastened in place, in some heat exchanger designs there was no further need for the troublesome support plates, but there was no easy way to remove them.

While the creation of magnetite is not wholly unexpected, the adverse consequences of its creation had not been fully appreciated. Magnetite, which is a ceramic material and is relatively "spongy", occupies a greater spatial volume than the steel which has been oxidized to form the magnetite. As the steel support structure oxidizes to magnetite and the magnetite builds up at the area where the tubing is surrounded by the support plate, the aperture between the support plate and tubing is reduced, and magnetite eventually fills the space between the support plate and the tubing.

As the oxidation process of steel to magnetite continues a phenomena known as "denting" or "pinching" takes place. The tubing in the primary system of the heat exchanger is constricted by the increasing volume of the magnetite, and the tubing can then be damaged and/or cracked. Further, the flow through the tubing can be substantially impeded at the site of the restriction. Eventually, the usefulness of the tube is reduced to virtually nothing and the tube must be capped at its base. When over 25% of these tubes are capped, the heat exchanger can no longer operate properly and a major and very costly repair of the entire heat exchanger unit must be undertaken.

The continued creation of magnetite with its volumetric increase over the steel it has replaced also tends to cause cracking and distortion of the steel support plates themselves. Fittings and other restraints attached to the support plates cannot accommodate this "expansion" process and structural stresses which are capable of exceeding the limits of the structure are generated thereby creating a deformation of the surrounding structure of the heat exchanger.

Experiments have been conducted to determine ways in which the heat exchanger system can be cleaned and the build-up removed. Chemical methods, such as those discussed in the above-identified paper of Obrecht, et al have been considered. Further, pilot scale experiments have been conducted to determine the relative efficiency of various chemical formulations in the "cleaning" process.

It has been found that more or less conventional chemical cleaning methods utilizing more or less accepted chemical cleaning formulations are so slow as to endanger the integrity of the heat exchanger system. That is, the same formulation which dissolves the magnetite and other scale and corrosion products, if left long enough to be effective, also attacks the basic structural elements of the heat exchanger as well. Further, the cleaning process is inhibited, especially in the apertures between the tubing and support plate, if the cleaning fluid cannot be adequately circulated or agitated to continually bring a fresh supply of cleaning fluid to the site to be cleaned.

It has long been known that sonic cleaning is a useful method for the decontamination of critical or precision parts and assemblies. The American Society for the Testing of Materials published, among other things, a special technical publication No. 342 in 1962, entitled "Cleaning and Materials Processing for Electronics and Space Apparatus."

In an article entitled "The Role of Cavitation in Sonic Energy Cleaning," written for that publication by T. J. Bulat, at page 119, the phenomenon of sonic cleaning is discussed at great length. It was suggested by Bulat, for example, that lower frequencies are better for cleaning massive parts and for penetrating interstices. Further, the effects of temperature were reviewed, revealing that in water, efficiency increases with elevated temperature until approximately 170° F. Higher temperatures appear to cause a loss in efficiency. However, it was suggested that optimum temperature ranges are more a function of the cleaning fluid to be utilized or the temperature at which the contaminants are most susceptible to breakdown. As summarized by Bulat, cleaning by sonic cavitation provides a direct and effective mechanical agitation to speed up the soil removal process and, at the same time, maintain a maximum concentration gradient of cleaning chemical at the surface to be cleaned. Further, the energy for cleaning can be focused and directed so that cavitation can be made to occur deep within the interstices of a part or of an assembly with a complicated geometric configuration.

Most early researchers endeavored to utilize sonic energy to keep the interior of the primary tubes free from surface deposits during use. See, for example, the patent to G. A. Worn, et al U.S. Pat. No. 2,664,274. That invention was primarily directed at improving the efficiency of heat exchangers by removing deposits from the interior of the tubing in the primary system and preventing the formation of deposits within said tubing during operation. Similarly, the patent to Bernard Ostrofsky, et al, U.S. Pat. No. 3,295,596, also taught the removal of deposits from the tubes of a heat exchanger while on-stream at elevated temperatures, through the use of a special liquid coupling device which isolated a sonic transducer from the adverse effects of the elevated temperatures in the heat exchanger system.

Yet another approach utilizing sonic energy has been disclosed by Alvin B. Kennedy, Jr., et al. U.S. Pat. No. 4,120,699 which teaches a continuous varying of the frequency or phase relationship of opposing accoustic wave trains which "sweep" over the surfaces of the body to be cleaned. It would seem that the Kennedy method is intended to clean the surfaces and restrict sedimentation. It appears, however, that the methods and apparatus described therein are intended for normal, preventive maintenance, and are not suited by themselves to the problems presently being considered.

SUMMARY OF THE PRESENT INVENTION

It has been discovered, according to the present invention, that a combination of chemical cleaning and relatively low frequency sonic cleaning can be adapted for the removal of oxidation products, and especially magnetite, from the structure supporting the tube bundle in the primary system of the heat exchanger of a nuclear reactor.

The chemical formula of magnetite is $Fe_3O_4$. The chemical reaction which controls the rate at which the magnetite is dissolved is as follows:

$$Fe_3O_4 + 8H^+ \rightarrow 2Fe^{+3} + Fe^{+2} + 4H_2O$$

To dissolve one magnetite molecule, $8H^+$ ions must be supplied, and 2 ferric ($Fe^{+3}$) ions, one ferrous ($Fe^2$) ion, and 4 water molecules must be removed. The rate at which the reaction proceeds is totally dependent on the available supply of hydronium ($H^+$ ion) and the rate of removal of iron and water. In the small interstices between the tubes and the support plates there is very little, if any, circulation of the chemical solution.

As a result, as the reaction proceeds and the chemicals dissolve the magnetite in the crevices and apertures between the tubing and support plate, the reaction rate tends to slow appreciably, as the site of the reaction becomes saturated with the resulting products and fresh chemicals cannot be brought to the site. It is therefore necessary to provide a means of agitating a mixing of the chemicals within the crevices or apertures between the tubing and support plate causing fresh chemicals to be brought to the magnetite. The use of sonic energy to mix and circulate the chemicals solves many of the prior art difficulties in cleaning heat exchangers such as steam generators.

An additional benefit to be obtained from the use of sonic energy is that a wholly different problem which has troubled steam generators for many years may also be attacked. There tends to be created a buildup of sedimentation or "sludge" which accumulates in the bottom of the heat exchanger vessel. This sludge includes copper oxide, magnetite, and other oxidation or corrosion products which have not adhered to the tubing or other surfaces and therefore accumulate at the bottom. As the sludge "pile" increases in thickness, it eventually covers portions of the tubing in the primary system and also builds up on the support plates for said tubing.

The presence of the sludge not only affects the rate of flow of the fluid in the secondary system, but also degrades the heat transfer process from the fluid in the primary system to the fluid in the secondary system. As the sludge layer deepens, the lowermost portion of the vessel becomes only marginally useful as a heat exchanger.

The use of sonic energy, together with appropriate chemicals, can first attack the sludge pile to prevent a later contamination of the chemicals that are used in the magnetite dissolving process. Cavitation and agitation of the sludge pile could facilitate removal of the sludge by a flushing and/or filtration process.

Further, and according to the present invention, the use of sonic energy to assist in cleaning and/or removal of detrimental deposits from thermal surfaces, tends to mix thoroughly the cleaning compounds and control the distribution of heat while preventing local "hot spots." Further, if heat is supplied, for example, by recirculating a heated fluid through the primary system, cavitation is enhanced in the vicinity of the tube bundle in the primary system. The presence of a "colder" region along the external surface of the heat exchanger facilitates the delivery of sound energy to the "warmer" regions surrounding said tube bundle.

As a part of the present invention, special transducers are employed which can be placed on the outer shell of the heat exchanger, within said shell, attached to the support plates or created of special shapes so as to focus energy at a desired area. Depending upon the access available, the transducers can be provided in various locations of the interior of the heater exchanger. If desirable, the transducer can be coupled directly to the support plates on the interior of the heat exchanger, enabling sonic energy to be delivered to the sites of magnetite buildup.

It is therefore an object of the present invention to provide a process and apparatus for removing the buildup of products of corrosion, oxidation, sedimentation and comparable chemical reactions from various portions of heat exchanger systems such as the location wherein the primary heat exchanger tubes in the primary system come in contact with support plates for said tube, and the base of said heat exchanger.

It is a further object of the present invention to provide a process and apparatus for removing corrosion deposits such as scale, oxides and the like from steam generators and other tube bundle heat exchangers.

It is another object of the present invention to provide a process and apparatus for accelerating action of chemical solvents in removing corrosion deposits in heat exchangers.

It is a further object of the present invention to provide a process for focusing and localizing the dissolving action of chemical solvents in heat exchangers.

It is another object of the present invention to provide a process and apparatus for removing magnetite from the crevices or apertures between the tubes of the primary system and support plates for those tubes in certain nuclear power plant steam generators and other heat exchangers.

It is a further object of the present invention to significantly reduce the chemical contact time required to "clean" steam generators and other heat exchangers.

It is another object of the present invention to provide a means for stimulating the activity of chemical solvents in the region of steam generator or heat exchanger support plates which support tubes within said steam generator or heat exchanger.

It is another object of the present invention to provide a process for removing corrosion from the interstices between tubes and their support plates in steam generators or heat exchangers without damaging other components within said steam generator or heat exchanger, which are chemically sensitive, such as the tubes, tube supports, the downcomer, exterior shell, and tube sheet at the base of the heat exchanger.

It is still another object of the present invention to provide a means for accelerating the action of chemical solvents, by causing agitation and local regions of high temperature and pressure at the interfaces between the solvent and components to be cleaned.

Further novel features and other objects of the present invention will become apparent from the following detailed description, discussion and the appended claims taken in conjunction with the drawings.

DRAWING SUMMARY

Referring particularly to the drawings for the purposes of illustration only and not limitation there is illustrated:

Figures 4, 5, 5A, 5B:
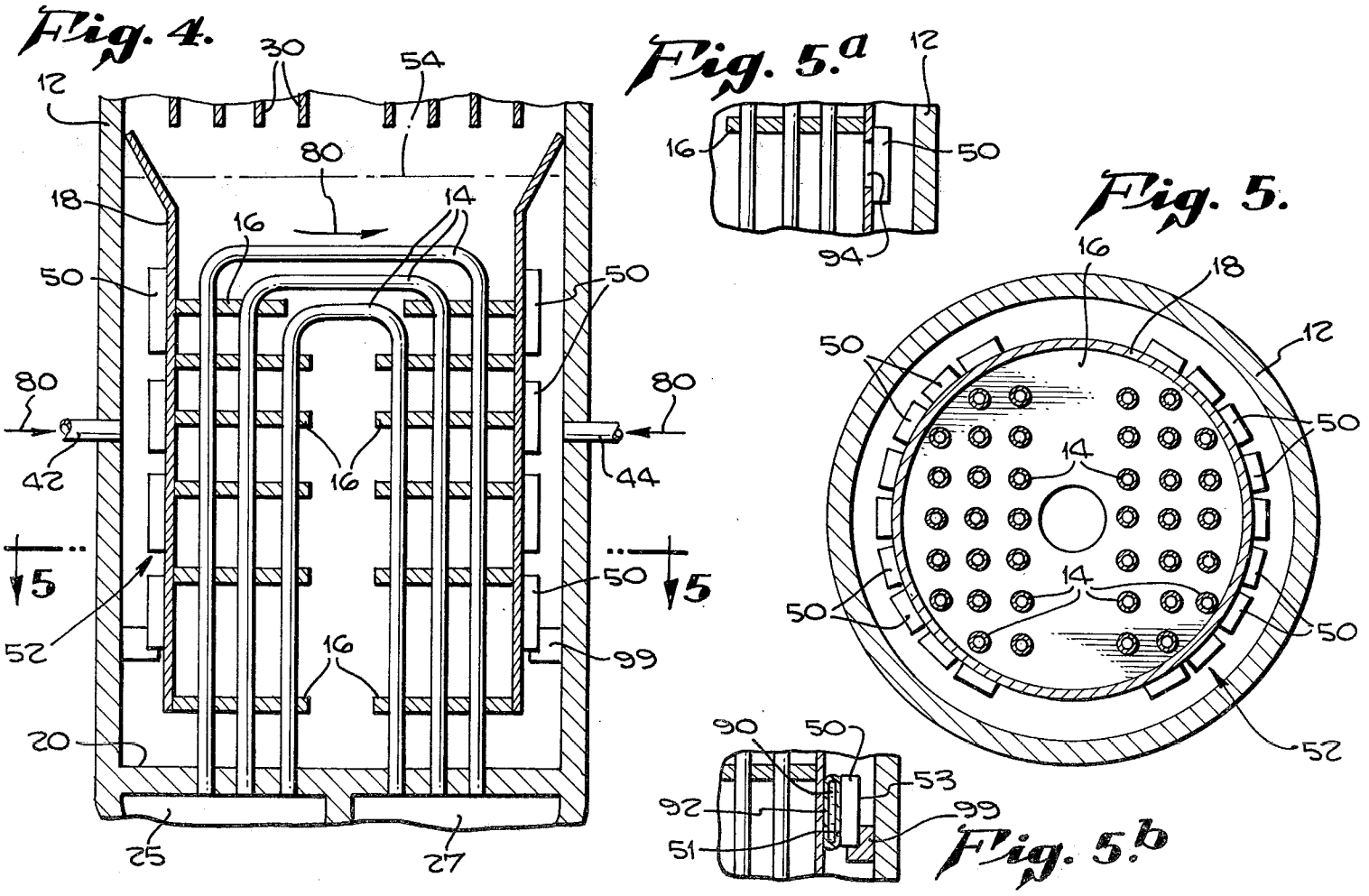
FIG. 4, is a side sectional view of a heat exchanger wherein sonic transducers have been positioned around the circumference of the metal wrapper which encircles the tube bundle and in alignment with each support plate, in accordance with an embodiment of the present invention.

FIGS. 5, 5*a*, and 5*b* are a plan view of a tube bundle and a support plate which would be placed within a heat exchanger where as shown in FIG. 4, sonic transducers have been placed in alignment with the support plate and are also positioned around the metal wrapper which encircles the tube bundle, in accordance with an embodiment of the present invention.

Figure 1:
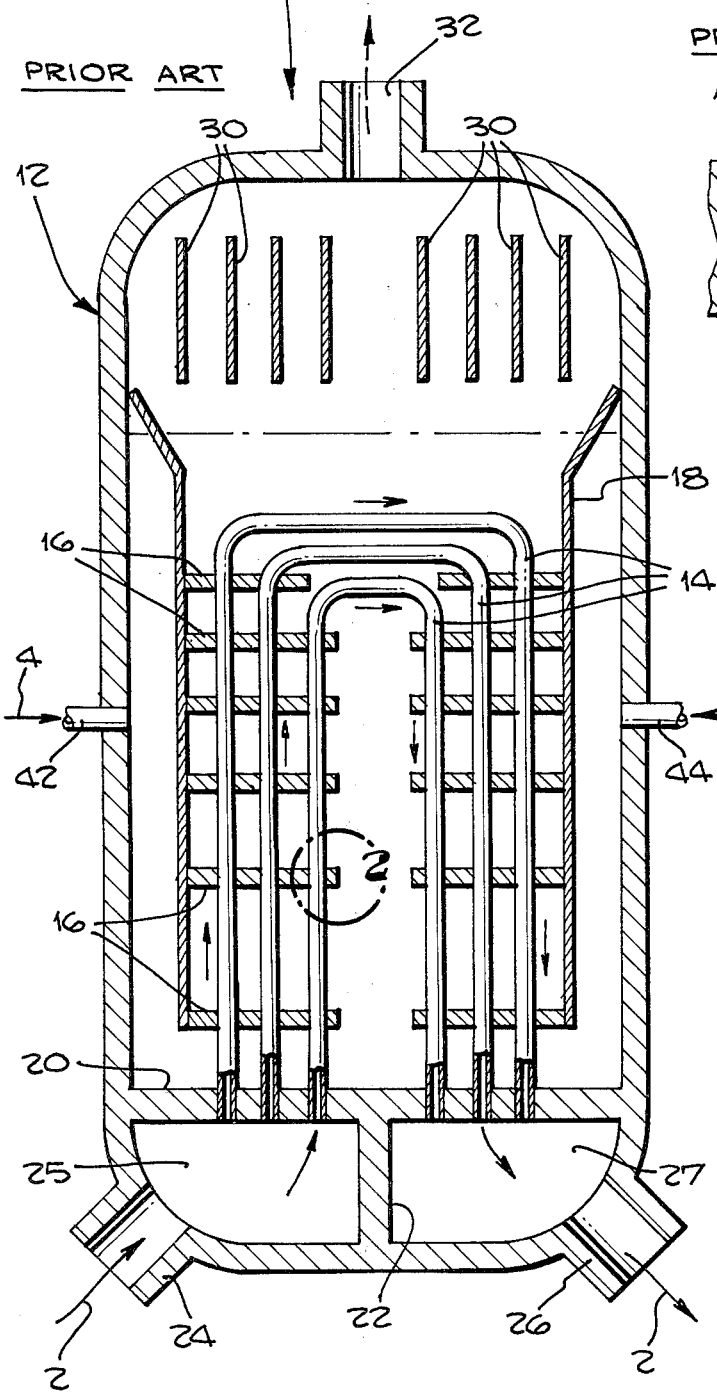
Fig. 1. PRIOR ART
FIG. 1, is a side sectional view of a typical heat exchanger which contains a tube bundle through which the primary fluid is circulated.
Figure 6:
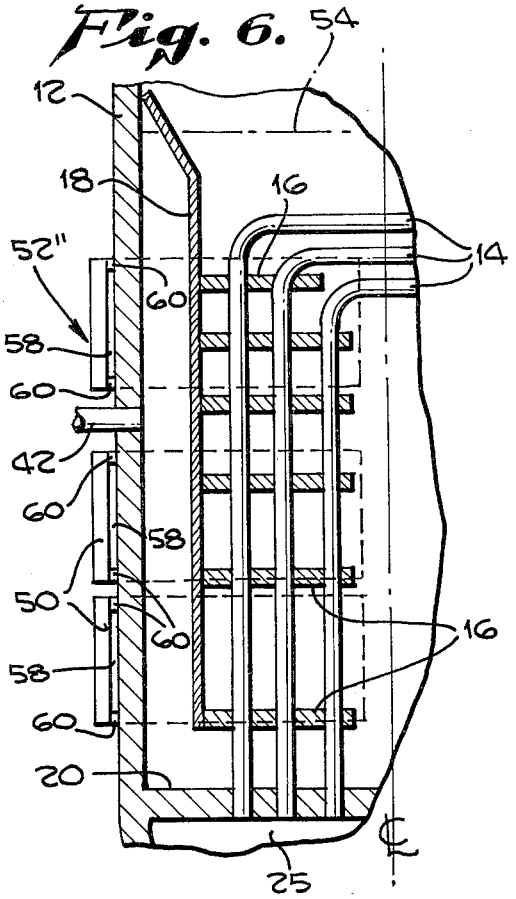

FIG. 6, is a partial side sectional view of the heat exchanger shown in FIG. 1 wherein sonic transducers have been positioned around the circumference of the external wall of the heat exchanger, in accordance with another embodiment of the present invention.

Figure 7:
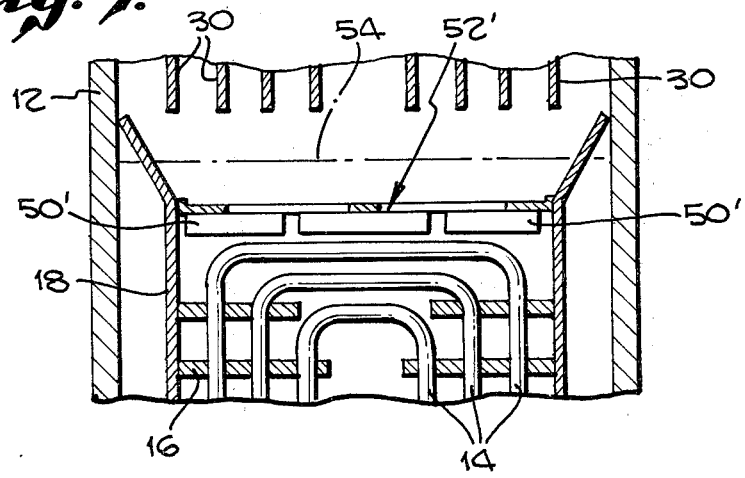

FIG. 7, is a partial side sectional view of the heat exchanger shown in FIG. 1, wherein sonic transducers have been positioned within the heat exchanger and above the tube bundle, in accordance with a further embodiment of the present invention.

Figure 8:
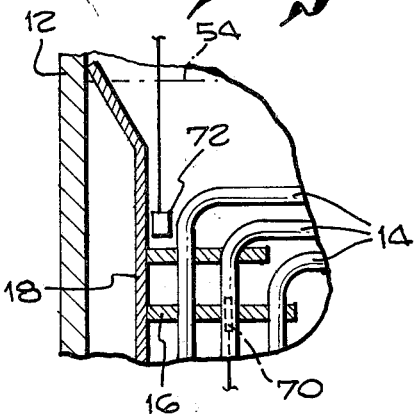

FIG. 8, is a partial side sectional view of the heat exchanger shown in FIG. 1, wherein sonic transducers are positioned within the tubes of the tube bundle in accordance with another embodiment of the present invention.

Figure 9:
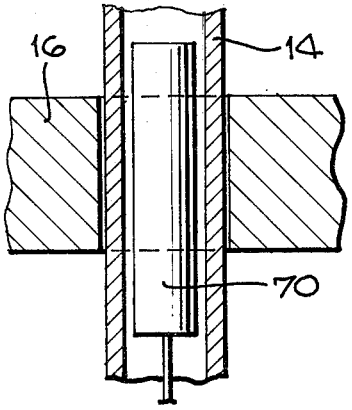

FIG. 9, is an enlarged view of a tube and its support plate with a sonic transducer positioned within said tube, in accordance with the embodiment of the present invention as shown in FIG. 8.

DETAILED DESCRIPTION OF THE PREFERRED EMBODIMENT

With reference to the drawings of the invention in detail and more particularly to FIG. 1, there is shown at 10 a steam generator or heat exchanger. The external shell or envelope 12 of said heat exchanger is a pressure vessel. Inside this external shell 12 are a large number of tubes 14 which are the tubes that carry the primary fluid within the primary system of said heat exchanger. Said tubes 14 pass through support plates 16 which are located along the length of said tubes 14 and which encircle each tube 14 so as to form a means for separating one tube from the next and allowing each tube to remain in a fixed position within the tube bundle. Said support plates 16 are in turn contained within a cylindrical iron wrapper 18. The tubes 14 are typically made of a nickel alloy such as inconel, and number on the order of 10,000, although the configuration of the heat exchanger and corresponding number of tubes will vary from manufacturer to manufacturer. The tubes 14 usually range from $\frac{5}{8}$ inch to $\frac{7}{8}$ inch in outer diameter and are approximately 50 mils in thickness. The support plates 16, in most current heat exchangers, are made of carbon steel and are approximately $\frac{3}{4}$ inch to 1 inch thick. The tubes 14 are connected at their bottom end to an apertured plate or tube sheet 20.

In normal operation, the primary fluid 2 comes from a heat source such as a nuclear reactor and enters said heat exchanger 10 through a primary entrance nozzle 24. The fluid enters into the area between the bottom of the pressure vessel external shell 12 and the tube sheet 20. A separating wall 22 separates the inlet side 25 of the heat exchanger 10 from the outlet side 27. The primary fluid 2 which comes from a heat source such as a nuclear reactor carries heat with it as it is forced through the various tubes 14 and up through the heat exchanger 10. The heat exchanger 10 illustrated in FIG. 1 is of the U-bend type, where the tubes 14 run most of the length of the heat exchanger 10 and are bent at the top to form a U-shaped configuration. The U-shaped tubes 14 are attached at their bottom to the tube sheet 20 which is mounted to the back of the external shell 12 of the heat exchanger 10, and thereby define the primary system of the heat exchanger 10. Upon reaching the uppermost portion of the tubes 14, the primary fluid 2 starts back down the opposite side of the tubes 14 and exits the heat exchanger 10 through the primary outlet nozzle 26 on the outlet side 27 of the heat exchanger 10.

Heat which is carried by the primary fluid 2 is transferred to the secondary fluid 4 while the primary fluid 2 is circulating through tubes 14. Said secondary fluid 4 enters the heat exchanger 10 through secondary inlets 42 and 44 located in the external shell 12 and is located in the area surrounding said tubes 14 and within the external shell 12. Sufficient heat is transferred to the secondary fluid 4 so that the primary fluid 2 exiting the primary outlet nozzle 26 is at a substantially lower temperature than it was when it entered the heat exchanger through primary inlet nozzle 24. The secondary fluid 4 absorbs heat carried by the primary fluid 2 and said secondary fluid 4 becomes steam during the heat absorption process. Said steam passes through separators 30 which remove excess moisture from said steam, and then exits through the steam outlet 32 at the top of the heat exchanger 10. The high pressure steam can then be used to drive a turbine. The secondary fluid 4, secondary inlets 42 and 44, separators 30, and steam outlet 32 define the secondary system of the heat exchanger 10.

The primary fluid 2 can be water. A gas such as helium or another liquid such as liquid sodium can also be used for the primary fluid. The secondary fluid 4 is usually water.

Figure 2:
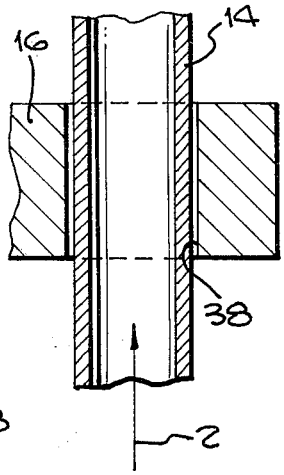
Fig. 2. PRIOR ART
FIG. 2, is a side sectional view of a tube and support plate junction which would be placed within a heat exchanger.
Figure 3:
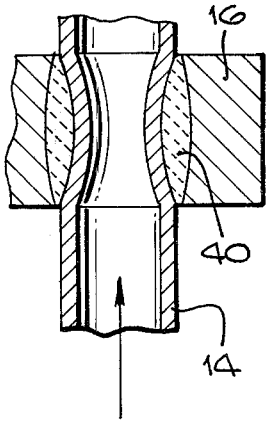
Fig. 3. PRIOR ART
FIG. 3, is a side sectional view of the tube shown in FIG. 2, but where in accordance with prior art technology part of the support plate has been oxidized to magnetite and the magnetite has filled the space between the tube and the support plate and further has caused denting in the walls of the tube.

Referring to FIG. 2, said support plates 16 contain apertures or crevices 38 through which said tubes 14 run. It is at the site of the apertures or crevices 38 that one of the problems which the present invention is intended to solve first occurs. In those heat exchangers in which the support plates 16 are made of steel, the elevated temperatures and water environment promote the oxidation of the support plates 16 and magnetite is formed from the steel on the exposed surfaces. As previously described, magnetite, which is a ceramic material and is relatively "spongy", occupies a greater spatial volume than the steel which has been oxidized to form the magnetite. As shown in FIG. 3, as the steel support plate 16 is oxidized to magnetite 40, and the magnetite 40 builds up at the area where the tubing 14 is surrounded by the support plate 16, the crevice or aperture 38 between the support plate 16 and tubing 14 is reduced, and magnetite 40 eventually fills the aperture 38 between the support plate 16 and the tubing 14. As further shown in FIG. 3, the phenomena known as "denting" or "pinching" takes place. The tubing 14 is constricted by the increasing volume of the magnetite 40, and can be damaged and/or cracked. The movement of fluid through the tubing 14 can be substantially impeded at the site of this restriction. Although magnetite 40 will also be created on other surfaces of support plate 16, conventional cleaning methods, such as those described by M. F. Obrecht, et al in his paper, Supra might be satisfactory to handle the problems at these other areas on the support plates 16. The magnetite 40 within the aperture 38, which causes the denting and deformation of tube 14, is not easily susceptible to the cleaning methods disclosed in the prior art. The chemical solvents cannot easily reach into this area. Conventional chemical cleaning methods utilizing more or less accepted chemical cleaning formulations are so slow as to endanger the integrity of the heat exchanger system. If these chemicals are left long enough to be effective against the magnetite, they will also attack the basic structural elements of the heat exchanger as well. Conventional chemical methods known in the prior art are also ineffective in removing the magnetite 40 at the aperture 38 because the cleaning fluid cannot be adequately circulated or agitated to continually bring a fresh supply of cleaning fluid to the site to be cleaned.

The present invention involves the process of and apparatus for removing the buildup of products of corrosion, oxidation, sedimentation, and comparable chemical reactions from various portions of heat exchanger systems such as the location wherein the primary heat exchanger tubes come in contact with support plates for those tubes. The process involves immersing the surfaces to be cleaned in a chemical solvent capable of attacking said buildup of products of corrosion, oxidation, sedimentation and comparable chemical reactions at a relatively slow rate. The solvent is then heated to desired temperatures adjacent said surfaces to be cleaned. Finally, the process involves generating a source of sonic energy to be used in conjunction with said chemical solvent and directing said sonic energy through said chemical solvent and to said surfaces to be cleaned at specific frequencies whereby cavitation of said sonic energy is combined with said chemical solvent so as to enhance and accelerate the removal of said buildup of products of corrosion, oxidation, sedimentation and comparable chemical reactions.

The present invention solves the problem of removing the magnetite 40 from the apertures or crevices 38 between said support plates 16 and said tubes 14. Referring to FIG. 4, a chemical solvent 80 is placed inside the heat exchanger 10 and within the exterior shell 12. Sufficient chemical solvent is put into the heat exchanger to cover said tubes 14 and said support plates 16, as shown in FIG. 4. One chemical solvent which can be used is the combination of 8% solution of sodium salt of ethylenediaminetetracetic acid (EDTA), plus 4% solution of citric acid plus an effective amount of a standard corrosion inhibitor (such as 0.6% of OSI-1 corrosion inhibitor sold by Halliburton Services).

Said chemical solvent 80 can be heated to a desired temperature, which is between 120° F. and 220° F. A preferred heating method would be the utilization of the primary circulating system to circulate a heated fluid through the tubes 14 until the solvent has reached its desired temperature. Once achieved, that temperature can be maintained by adding heat through the primary system. Alternatively, the chemical solvent 80 can be heated externally and then the heated solvent 80 can be added to the secondary system inside the heat exchanger 10. This method is less desirable than the preferred method because it requires the heating and circulating of a potentially hazardous and corrosive substance. Further, utilizing a benign heating fluid through the tubes 14 in the primary system provides the additional benefit of inducing a convection flow of the chemical solvent 80 at the interfaces of the tubes 14 and the support plates 16. Care should be taken that the temperatures at the interfaces of the tubes 14 and the support plates 16 during the cleaning process does not exceed the desired levels since undue heating adversely affects the efficiency of the sonic cleaning process.

Sonic energy is generated from transducers 50 which contain a face 51 and a rear portion 53. Referring to FIGS. 4 and 5, the preferred placement of the sonic transducers 50 is shown in the form of a ring 52 of such transducers encircling the wrapper 18 which in turn encircles the support plates 16 and tubes 14. The wrapper 18 significantly reduces the effectiveness of sonic energy generated by the sonic transducers 50. Further, a problem is created because the thin fluid layer of chemical solvent 80 which is trapped between the transducer face 51 and the wrapper 18 cavitates or boils due to the heat generated by the transducer 50 and this is turn decouples the transducer 50 from the wrapper 18. This problem is solved by either of the following means. The first and preferred method shown in FIG. 5*b*, involves placing a thin layer of high boiling point fluid 90 between the transducer face 51 and the wrapper 18. The fluid 90, such as oil, can be placed in a container 92 such as a flexible plastic bag which is approximately ⅛ inch thick, and will remain in place by pressure between the face of the transducer 50 and the wrapper 18. The combination of this coupling fluid 90 and the container 92 for the fluid 90 should have the same acoustic impedance as the metal wrapper 18 in order to have good sonic transmission. The transducers 50 are held firmly against the fluid filled container 92 or metal wrapper 18 by mechanical means such as a support wedge 99 placed between the rear portion of the transducer 53 and the internal vertical portion of the shell 12, or by direct mechanical or magnetic attachment to the metal wrapper 18. In the second method, shown in FIG. 5*a*, windows 94 whose dimensions are approximately the size of the transducer face 50 are cut in the wrapper 18 portion in front of each transducer 50. After the cleaning process has been completed, these windows 94 are sealed by replacing the metal removed on cutting the window 94 in the wrapper 18 and welding the piece of metal back in place. When the windows 94 are cut slightly smaller than the face of the transducer 51, the transducer can be held in place against the metal wrapper 18 by direct mechanical or magnetic attachment to the metal wrapper 18, or by mechanical means such as a support wedge 99 placed between the rear portion of the transducer 53 and the internal vertical portion of the shell 12. When the window 94 is cut slightly larger than the face of the transducer 51, part of the transducer 50 can be placed through the metal wrapper and will remain in place in this fashion.

The ring 52 of transducers 50 is energized to radiate sonic energy in the frequency spectrum between 2 KHZ and 200 KHZ. The choice of these frequencies permits improved coupling of the sonic energy into the chemical solvent 80 and to the sites of interest such as the aperture 38 between the support plates 16 and tubes 14. The optimum cleaning interval for any heat exchanger can be experimentally determined, but it is believed that approximately 24 hours of sonic irradiation should be adequate to clean the first or uppermost plate.

Sonic irradiation can be extended for longer periods as necessary. Results of experimental tests have shown that over a 24 hour cleaning period negligible adverse effects from the chemical solvent 80 are experienced by the other components. Some experiments suggest that the cleaning process may be accomplished in somewhat less time and, in any given heat exchanger, it may be possible to visually observe the progress of the cleaning, at least insofar as the uppermost support plate is concerned, since it might be subject to visual monitoring.

As each plate 16 is cleaned, the fluid level is dropped as is the ring 52 of transducers 50 and the process is repeated. This procedure, has, however, the effect of exposing at least the lower portions of the vessel to the chemical solvent for longer periods of time. In view of the longer, but "passive" exposure to the solvent, as one proceeds toward the bottom of the tank the period of time during which the sonic transducers are operated at each fluid level is progressively reduced.

It has been experimentally determined that using the chemical solvent 80 alone without sonic energy irradiation would require approximately 8 days to achieve a similar cleaning effect as is achieved by the present invention in only one day. Therefore, the adverse affects of the solvent 80 on the components of the heat exchanger are substantially reduced due to the significant decrease in time that the solvent 80 must remain inside the heat exchanger.

The embodiment of the present invention described above requires the use of a ring of sonic transducers around the outer circumference of the metal wrapper 18 of the heat exchanger 10. As each support plate and tube is cleaned, the cleaning solvent level 80 is lowered to a few inches above the next support plate and the ring 52 of sonic transducers 50 is lowered to be in alignment with the next support plate to be cleaned, as shown in FIG. 5. A key point in this process is that the level of chemical solvent must be only a few inches above the surface area to be cleaned. If the level is much higher, the effectiveness of the sonic energy in creating the cavitation at the site to be cleaned is significantly reduced.

In order to create cavitation at the site to be cleaned, the transducers must be able to generate a power output greater than about 0.2 watts per square centimeter at room temperature. This power density limitation on the transducers is demonstrated in the textbook "Sonics—Techniques For The Use Of Sound And Ultrasound In Engineering And Science, by Theodor F. Huetter and Richard H. Bolt, Fourth Edition published in 1965," pages 228 to 232. Referring specifically to FIG. 6.13 on page 230 of said textbook, in order to produce cavitation in degassed water at room temperature, the transducer must generate approximately 0.2 watts per cubic centimeter. As shown by the chart, if the transducer has a power output greater than about 0.2 watts per square centimeter, cavitation will be produced over a broad frequency range.

An alternative embodiment of the present invention is shown in FIG. 6 wherein the ring 52'' of transducers 50'' is wholly exterior to the heat exchanger 10 and is placed around the outer circumference of the external shell 12 of the heat exchanger 10. In this embodiment, the actual cleaning procedure would be substantially similar to that of the preferred embodiment described above except that the ring 52'' of transducers 50'' is mounted on the outside and must be "coupled" to the interior of the vessel. The heat exchanger 10 is filled with the chemical solvent 80 which is heated to the desired temperature. The ring 52'' of transducers 50'' is placed at the height of the uppermost support plate 16 and is energized. The sonic energy is transmitted to the interior through a sonic coupler 58 which may include a fluid held in place by seals 60. As each support plate and tube is cleaned, the cleaning solvent level 80 is lowered to just above the next support plate and the ring 52'' of sonic transducers 50'' is lowered to be in alignment with the next support plate to be cleaned. The patent to Ostrofsky, U.S. Pat. No. 3,295,596 illustrates a particular coupler apparatus which would be employed. The embodiment of the present invention is designed to be used with those heat exchangers where interior access is either severely limited or is considered too hazardous.

The rings 52, 52'' of transducers 50, 50'' can be successively repositioned in the vertical direction during the cleaning process. At each repositioning, the fluid level is lowered to a height above the transducer ring sufficient to support and maintain the efficient transmission of sonic radiation to the surfaces to be cleaned. As shown, the tubes and plates are cleaned in increments.

It may be sufficient that each increment includes one of the support plates and that a suitable interval of time is employed to irradiate the plate. The time required for each of the plates can, of course, be experimentally determined. However, it is believed that although the sonic energy is primarily directed at a particular plate and its tube intersections, the adjacent plates will also benefit from the sonic energy and the cleaning of those plates will proceed, as well.

The time required for the later increments may be progressively less, so that by the time the lowermost plate is reached, the required cleaning time for this plate will be substantially less than for the others. The total time during which the lowermost portions of the heat exchanger have been immersed in the solvent bath will, nevertheless, be substantially less than required through the use of solvents alone.

Because the cleaning action of the solvent 80 is intensified, it is possible to use a chemical solvent at greater concentrations for shorter cleaning time. Depending upon the construction of the heat exchanger and the materials used in its fabrication, some optimum combination of solvent strength and cleaning time can be devised to minimize the unwanted effects of the solvents on the structural components.

Many of the special fluid properties necessary to maximize the efficiency of the sonic cleaning process, can be achieved in the compounding of the chemical solvent. The solvent should be active at relatively low temperatures (below 200° F.) and be substantially immune to the effects of sonic cavitation. Further, the solvent should optimize those properties which support high cavitation energy levels such as high surface tension, low vapor pressure and low viscosity.

The utilization of sonic energy in the cleaning process not only has a direct effect on the scale, corrosion products and magnetite, but also enhances the effect of the chemical solvent by agitating and circulating the solvent in the regions being cleaned. This agitation tends to carry away "saturated solvent" and waste products, and brings fresh solvent to the region so that the solvent does not lose its effectiveness.

While the process of cleaning the particular surfaces of the heat exchanger has been described, the presence of the sludge pile, and its effect on the cleaning process has not been considered heretofore. Because the sludge pile does contain a large quantity of loose sediment, magnetite, copper and other corrosion products, the fluid agitation caused by the sonic cavitation may stir up the sludge and its presence may actually interfere with the cleaning action of the solvent upon the structural parts.

It may therefore be desirable to initiate a preliminary cleaning process in an attempt to remove the sludge pile before any other cleaning is attempted. For this operation, it may be preferable to have transducers mounted to the exterior shell 12 of the heat exchanger 10 and to use a fairly concentrated and relatively strong chemical solvent which just covers the sludge pile only and is not brought in contact with the remaining structural elements. Is is also possible that through the application of sonic energy alone, the sludge pile can be "stirred up" sufficiently to enable a flushing operation to carry away a substantial portion of the sludge pile, without the need for chemical solvent action.

If the removal of the sludge pile is not to be undertaken, it may be necessary to provide some physical isolation of the sludge pile from the cleaning solvent so as not to contaminate and/or neutralize the chemical solvent before it has had a change to work on the structures to be cleaned. In this event, it may be necessary to provide a blanketing layer of an appropriate liquid which will effectively isolate the sludge pile from the chemical solvent bath.

Another alternative embodiment of the present invention is shown in FIG. 7 wherein the ring 52' of transducers 50' are placed inside the heat exchanger 10 and inside the metal wrapper 18, and over the bundle of and substantially parallel to the tubes 14. The effectiveness of this placement may be limited if the vessel is quite deep. Very deep vessels might not be optimally served. However, for those heat exchangers in which the embodiment can be successfully employed, it offers the advantages of both easier installation and removal.

Turning next to FIG. 8 and FIG. 9, there is shown an additional alternative embodiment of the present invention. As shown, individual sonic transducers 70 are placed within selected tubes 14 of the primary system. Energizing these transducers 70 can concentrate the sonic energy in the immediate vicinity of the tubes 14. By appropriate positioning of a transducer 70, along the axis of the tube, the energy can be successively directed to the deposits at each of the support plates 16, in turn.

This application of the present invention can also be used to clean tubes which are badly corroded internally or which are dented. The cleaning of these tubes would prevent further tube damage and would eliminate the need to remove tubes from service by plugging them at the tube sheet 20.

Access to the interior of the tubes can be achieved either from the manifold area at the primary inlet 24 and primary outlet 26, or, selected tubes can be cut and later repaired when the cleaning process has been concluded. These transducers 70 mounted interior to the tubes 14 could be employed in conjunction with other transducers which could be either mounted on the exterior wall 12 of the heat exchanger 10 or mounted on the metal wrapper 18 to operate in a cooperating and coordinated fashion. Alternatively, if relatively unrestricted access can be gained to the interior of the heat exchanger, some transducer elements can be attached directly to support plates 16.

As shown in FIG. 8, it is also possible to utilize pressure sensitive transducers 72 at various locations within the vessel to determine the magnitude of sonic energy at selected locations. This monitoring capability can increase the efficiency of the cleaning process since the sonic transducers 70 can then be selectively or differentially driven to maximize the cleaning action at desired locations.

Other variations and modifications will appear to those skilled in the art in terms of instrumentation, directing the sonic energy and using measurements of water pressure and frequency to determine the energy level at any given point within the heat exchanger system. Where time is a critical factor, as in the cleaning of the heat exchanger portion of a nuclear reactor, the present invention provides time savings that are appreciable and significant.

Of course, the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the methods shown are intended only for illustration and for disclosure of an operative embodiment and not to show all of the various forms of modification in which the invention might be embodied.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

We claim:

1. In the art of maintaining a steam generator for a nuclear power plant in which the steam generator is characterized by an enclosed tank containing a plurality of heat exchanger tubes and a plurality of support plates arranged transverse to and sequentially spaced along the longitudinal axis of the tubes and forming junctions therewith, where crevices exist between the heat exchanger tubes and the support plates at the site of the junctions, the junctions being thereby arranged in a series of groups, and also containing an outer shell and a metal wrapper inside the tank which envelops the plurality of tubes and support plates, and wherein magnetite tends to build up within the crevices at the junctions over a period of time, the process of removing the magnetite from the crevices and the junctions while the heat exchanger tubes and support plates remain in their operative position inside the steam generator, comprising the steps of:

a. selecting a chemical solvent which when heated to a temperature between 120 degrees Fahrenheit and 220 degrees Fahrenheit dissolves magnetite exposed to fresh chemicals at a rate equal to or greater than about 1.0 inch per 24 hours;

b. adding a metal corrosion inhibitor to said chemical solvent;

c. at least partially filling the tank with said chemical solvent, so as to establish an initial level which is only a few inches above the level of the uppermost group of junctions and their uppermost group of crevices;

d. selecting a plurality of sonic transducers wherein each sonic transducer has a power output greater than about 0.2 watts per square centimeter at room temperature;

e. placing said plurality of sonic transducers at a level which is below the surface of said chemical solvent, substantially in the plane of said uppermost group of junctions and uppermost group of crevices and in spaced locations around the circumference of and in contact with said metal wrapper;

f. running a hot fluid through said heat exchanger tubes so that the chemical solvent in the region adjacent said junctions and crevices reaches a temperature between 120 degrees Fahrenheit and 220 degrees Fahrenheit;

g. activating said sonic transducers to a frequency in the range of about 2 KHZ to 200 KHZ so that sonic energy is transmitted through said chemical solvent to said junctions and into and laterally of said crevices whereby cavitation induced at said junctions and at said crevices by said sonic energy cooperates with said chemical solvent so as to enhance and accelerate the removal of the magnetite from said junctions and crevices;

h. continuing the cooperative action of said hot chemical solvent and said transducers upon said uppermost group of junctions and crevices until the magnetite is removed from the junctions and crevices;

i. maintaining said chemical solvent at a temperature between 120 degrees Fahrenheit and 220 degrees Fahrenheit;

j. then lowering the level of said chemical solvent to a height which is only a few inches above the next group of junctions and crevices from which magnetite is to be removed, lowering said plurality of transducers to a corresponding lower location on said metal wrapper in a plane substantially in alignment with said next group of junctions and crevices, and again applying said cooperative effort between said hot chemical solvent and said transducers until the magnetite is removed from said next group of junctions and next group of crevices; and k. continuing in this fashion at the level of each successive group of junctions and crevices until all of said junctions and crevices have been cleaned.

2. In the art of maintaining a steam generator for a nuclear power plane in which the steam generator is characterized by an enclosed tank containing a plurality of heat exchanger tubes and a plurality of support plates arranged transverse to and sequentially spaced along the longitudinal axes of the tubes and forming junctions therewith, where crevices exist between the heat exchanger tubes and the support plates at the site of the junctions, the junctions being thereby arranged in a series of groups, and also containing an outer shell and a metal wrapper inside the tank which envelops the plurality of tubes and support plates, and wherein magnetite tends to build up within the crevices at the junctions over a period of time, the process of removing the magnetite from the crevices and the junctions while the heat exchanger tubes and support plates remain in their operative positions inside the steam generator, comprising the steps of:

a. selecting a chemical solvent which when heated to a temperature between 120 degrees Fahrenheit and 220 degrees Fahrenheit dissolves magnetite exposed to fresh chemicals at a rate equal to or greater than about 1.0 inch per 24 hours;

b. adding a metal corrosion inhibitor to said chemical solvent;

c. at least partially filling the tank with said chemical solvent, so as to establish an initial level which is only a few inches above the level of the lowermost group of junctions and their lowermost group of crevices;

d. selecting a plurality of sonic transducers wherein each sonic transducer has a power output greater than about 0.2 watts per square centimeter at room temperature;

e. placing said plurality of sonic transducers at a level which is below the surface of said chemical solvent, substantially in the plane of said lowermost group of junctions and lowermost group of crevices and in spaced locations around the circumference of and in contact with said metal wrapper;

f. running a hot fluid through said heat exchanger tubes so that the chemical solvent in the region adjacent said junctions and crevices reaches a temperature between 120 degrees Fahrenheit and 220 degrees Farenheit;

g. activating said sonic transducers to a frequency in the range of about 2 KHZ to 200 KHZ so that sonic energy is transmitted through said chemical solvent to said junctions and into and laterally of said crevices whereby cavitation induced at said junctions and at said crevices by said sonic energy cooperates with said chemical solvent so as to enhance and accelerate the removal of the magnetite from said junctions and crevices;

h. continuing the cooperative action of said hot chemical solvent and said transducers upon said lowermost group of junctions and crevices until the magnetite is removed from the junctions and crevices;

i. maintaining said chemical solvent at a temperature between 120 degrees Fahrenheit and 220 degrees Fahrenheit;

j. then raising the level of said chemical solvent to a height which is only a few inches above the next group of junctions and crevices from which magnetite is to be removed, raising said plurality of transducers to a corresponding higher location on said metal wrapper in a plane substantially in alignment with said next group of junctions and crevices, and again applying said cooperative effort between said hot chemical solvent and said transducers until the magnetite is removed from said next group of junctions and next group of crevices; and k. continuing in this fashion at the level of each successive group of junctions and crevices until all of said junctions and crevices have been cleaned.

3. In the art of maintaining a steam generator for a nuclear power plant in which the steam generator is characterized by an enclosed tank containing a plurality of heat exchanger tubes and a plurality of support plates arranged transverse to and sequentially spaced along the longitudinal axes of the tubes and forming junctions therewith, where crevices exist between the heat exchanger tubes and the support plates at the site of the junctions, the junctions being thereby arranged in a series of groups, and also containing an outer shell and a metal wrapper inside the tank which envelops the plurality of tubes and support plates, and wherein magnetite tends to build up within the crevices at the junctions over a period of time, the process of removing the magnetite from the crevices and the junctions while the heat exchanger tubes and support plates remain in their operative positions inside the steam generator, comprising the steps of:

a. selecting a chemical solvent which when heated to a temperature between 120 degrees Fahrenheit and 220 degrees Fahrenheit dissolves magnetite exposed to fresh chemicals at a rate equal to or greater than about 1.0 inch per 24 hours;

b. adding a metal corrosion inhibitor to said chemical solvent;

c. at least partially filling the tank with said chemical solvent, so as to establish an initial level which is only a few inches above the level of the uppermost group of junctions and their uppermost group of crevices;

d. selecting a plurality of sonic transducers wherein each sonic transducer has a power output greater than about 0.2 watts per square centimeter at room temperature;

e. placing said plurality of sonic transducers at a level which is substantially in the plane of each of said groups of junctions and in spaced locations around the circumference of and in contact with said metal wrapper;

f. running a hot fluid through said heat exchanger tubes so that the chemical solvent in the region adjacent said junctions and crevices reaches a temperature between 120 degrees Fahrenheit and 220 degrees Fahrenheit;

g. activating all the transducers simultaneously at each level substantially in the plane of each group of junctions and each group of crevices to a frequency in the range of about 2 KHZ to 200 KHZ so that sonic energy is transmitted through said chemical solvent to each group of junctions and into and laterally of each group of crevices whereby cavitation induced at each group of junctions and each group of crevices cooperates with said chemical solvent so as to enhance and accelerate the removal of the magnetite from the all of the junctions and crevices;

h. continuing the cooperative action of said hot chemical solvent and said transducers upon each group of junctions and crevices until the magnetite is removed from all of the junctions and all of the crevices.

4. In the art of maintaining a steam generator for a nuclear power plant in which the steam generator is characterized by an enclosed tank containing a plurality of heat exchanger tubes and a plurality of support plates arranged transverse to and sequentially spaced along the longitudinal axes of the tubes and forming junctions therewith, where crevices exist between the heat exchanger tubes and the support plates at the site of the junctions, the junctions being thereby arranged in a series of groups, and also containing an outer shell and a metal wrapper inside the tank which envelops the plurality of tubes and support plates, and wherein magnetite tends to build up within the crevices at the junctions over a period of time, the process of removing the magnetite from the crevices and the junctions while the heat exchanger tubes and support plates remain in their operative positions inside the steam generator, comprising the steps of:

a. selecting a chemical solvent which when heated to a temperature between 120 degrees Fahrenheit and 220 degrees Fahrenheit dissolves magnetite exposed to fresh chemicals at a rate equal to or greater than about 1.0 inch per 24 hours;
b. adding a metal corrosion inhibitor to said chemical solvent;
c. selecting a plurality of sonic transducers wherein each sonic transducer has a power output greater than about 0.2 watts per square centimeter at room temperature;
d. placing said plurality of sonic transducers at a level substantially in the plane of the uppermost group of junctions and uppermost group of crevices and in spaced locations around the circumference of and in contact with said metal wrapper;
e. heating said chemical solvent to a temperature between 120 degrees Fahrenheit and 220 degrees Fahrenheit at a location outside of said steam generator;
f. at least partially filling the tank with said heated chemical solvent, so as to establish an initial level which is only a few inches above the level of the uppermost group of junctions and their uppermost group of crevices;
g. activating said sonic transducers to a frequency in the range of about 2 KHZ to 200 KHZ so that sonic energy is transmitted through said chemical solvent to said junctions and into and laterally of said crevices whereby cavitation induced at said junctions and at said crevices by said sonic energy cooperates with said chemical solvent so as to enhance and accelerate the removal of magnetite from said junctions and crevices;
h. continuing the cooperative action of said hot chemical solvent and said transducers upon said uppermost group of junctions and crevices until the magnetite is removed from the junctions and crevices;
i. maintaining said chemical solvent at a temperature between 120 degrees Fahrenheit and 220 degrees Fahrenheit;
j. then lowering the level of said chemical solvent to a height which is only a few inches above the next group of junctions and crevices from which magnetite is to be removed, lowering said plurality of transducers to a corresponding lower location on said metal wrapper in a plane substantially in alignment with said next group of junctions and crevices, and again applying said cooperative effort between said hot chemical solvent and said transducers until the magnetite is removed from said next group of junctions and next group of crevices; and
k. continuing in this fashion at the level of each successive group of junctions and crevices until all of said junctions and crevices have been cleaned.

5. In the art of maintaining a steam generator for a nuclear power plant in which the steam generator is characterized by an enclosed tank containing a plurality of heat exchanger tubes and a plurality of support plates arranged transverse to and sequentially spaced along the longitudinal axes of the tubes and forming junctions therewith, where crevices exist between the heat exchanger tubes and the support plates at the site of the junctions, the junctions being thereby arranged in a series of groups, and also containing an outer shell and a metal wrapper inside the tank which envelops the plurality of tubes and support plates, and wherein magnetite tends to build up within the crevices at the junctions over a period of time, the process of removing the magnetite from the crevices and the junctions while the heat exchanger tubes and support plates remain in their operative positions inside the steam generator, comprising the steps of:

a. selecting a chemical solvent which when heated to a temperature between 120 degrees Fahrenheit and 220 degrees Fahrenheit dissolves magnetite exposed to fresh chemicals at a rate equal to or greater than about 1.0 inch per 24 hours;
b. adding a metal corrosion inhibitor to said chemical solvent;
c. selecting a plurality of sonic transducers wherein each sonic transducer has a power output greater than about 0.2 watts per square centimeter at room temperature;
d. placing said plurality of sonic transducers at a level substantially in the plane of the lowermost group of junctions and lowermost group of crevices and in spaced locations around the circumference of and in contact with said metal wrapper;
e. heating said chemical solvent to a temperature between 120 degrees Fahrenheit and 220 degrees Fahrenheit at a location outside of said steam generator;
f. at least partially filling the tank with said heated chemical solvent, so as to establish an initial level which is only a few inches above the level of the lowermost group of junctions and their lowermost group of crevices;
g. activating said sonic transducers to a frequency in the range of about 2 KHZ to 200 KHZ so that sonic energy is transmitted through said chemical solvent to said junctions and into and laterally of said crevices whereby cavitation induced at said junctions and at said crevices by said sonic energy cooperates with said chemical solvent so as to enhance and accelerate the removal of the magnetite from said junctions and crevices;
h. continuing the cooperative action of said hot chemical solvent and said transducers upon said lowermost group of junctions and crevices until the magnetite is removed from the junctions and crevices;
i. maintaining said chemical solvent at a temperature between 120 degrees Fahrenheit and 220 degrees Fahrenheit;
j. then raising the level of said chemical solvent to a height which is only a few inches above the next group of junctions and crevices from which magnetite is to be removed, raising said plurality of transducers to a corresponding higher location on said metal wrapper in a plane substantially in alignment with said next group of junctions and crevices, and again applying said cooperative effort between said hot chemical solvent and said transducers until the magnetite is removed from said next group of junctions and next group of crevices; and k. continuing in this fashion at the level of each successive group of junctions and crevices until all of said junctions and crevices have been cleaned.

6. In the art of maintaining a steam generator for a nuclear power plant in which the steam generator is characterized by an enclosed tank containing a plurality of heat exchanger tubes and a plurality of support plates arranged transverse to and sequentially spaced along the longitudinal axes of the tubes and forming junctions therewith, where crevices exist between the heat exchanger tubes and the support plates at the site of the junctions, the junctions being thereby arranged in a series of groups, and also containing an outer shell and a metal wrapper inside the tank which envelops the plurality of tubes and support plates, and wherein magnetite tends to build up within the crevices at the junctions over a period of time, the process of removing the magnetite from the crevices and the junctions while the heat exchanger tubes and support plates remain in their operative positions inside the steam generator, comprising the steps of:

a. selecting a chemical solvent which when heated to a temperature between 120 degrees Fahrenheit and 220 degrees Fahrenheit dissolves magnetite exposed to fresh chemicals at a rate equal to or greater than about 1.0 inch per 24 hours;

b. adding a metal corrosion inhibitor to said chemical solvent;

c. selecting a plurality of sonic transducers wherein each sonic transducer has a power output greater than about 0.2 watts per square centimeter at room temperature;

d. placing said plurality of sonic transducers at a level which is substantially in the plane of each of said groups of junctions and in spaced locations around the circumference of and in contact with said metal wrapper;

e. heating said chemical solvent to a temperature between 120 degrees Fahrenheit and 220 degrees Fahrenheit at a location outside of said steam generator;

f. at least partially filling the tank with said heated chemical solvent, so as to establish an initial level which is only a few inches above the level of the uppermost group of junctions and their uppermost group of crevices;

g. activating all the transducers simultaneously at each level substantially in the plane of each group of junctions and each group of crevices to a frequency in the range of about 2 KHZ to 200 KHZ so that sonic energy is transmitted through said chemical solvent to each group of junctions and into and laterally of each group of crevices whereby cavitation induced at each group of junctions and each group of crevices cooperates with said chemical solvent so as to enhance and accelerate the removal of the magnetite from all of the junctions and crevices;

h. continuing the cooperative action of said hot chemical solvent and said transducers upon each group of junctions and crevices until the magnetite is removed from all of the junctions and all of the crevices.

7. In the art of maintaining a steam generator for a nuclear power plant in which the steam generator is characterized by an enclosed tank containing a base plate on the lower portion of its interior surface, and wherein the products of corrosion, oxidation, sedimentation and comparable chemical reactions form a sludge pile over a period of time on the base plate, the process of removing the sludge pile while the base plate remains in its operative position inside the steam generator, comprising the steps of:

a. selecting a chemical solvent which when heated to a temperature between 120 degrees Fahrenheit and 220 degrees Fahrenheit dislodges the sludge from the base plate within 24 hours;

b. at least partially filling the tank with said chemical solvent, so as to establish an initial level which is only a few inches above the level of said base plate;

c. adding a metal corrosion inhibitor to said chemical solvent;

d. selecting a plurality of sonic transducers wherein each sonic transducer has a power output greater than about 0.2 watts per square centimenter at room temperature;

e. placing said plurality of sonic transducers at a level which is below the surface of said chemical solvent, substantially in the plane of said base plate, and in spaced locations around the circumference of the tank;

f. heating said chemical solvent to a temperature between 120 degrees Fahrenheit and 220 degrees Fahrenheit adjacent said base plate;

g. activating said sonic transducers to a frequency in the range of about 2 KHZ to 200 KHZ so that sonic energy is transmitted through said chemical solvent and into said sludge pile whereby cavitation induced at said base plate by said sonic energy cooperates with said chemical solvent so as to enchance and accelerate the removal of said sludge pile from said base plate;

h. continuing the cooperative actions of said hot chemical solvent and said transducers upon said base plate for several hours until the sludge pile is removed from said base plate; and i. flushing said steam generator with a liquid to remove said sludge pile from said steam generator.

8. In the art of maintaining a steam generator for a nuclear power plant in which the steam generator is characterized by an enclosed tank containing a base plate on the lower portion of its interior surface, and wherein the products of corrosion, oxidation, sedimentation and comparable chemical reactions form a sludge pile over a period of time on the base plate, the process of removing the sludge pile while the base plate remains in its operative position inside the steam generator, comprising the steps of:

a. selecting a chemical solvent which when heated to a temperature between 120 degrees Fahrenheit and 220 degrees Fahrenheit dislodges the sludge from the base plate within 24 hours;

b. adding a metal corrosion inhibitor to said chemical solvent;

c. selecting a plurality of sonic transducers wherein each sonic transducer has a power output greater than about 0.2 watts per square centimenter at room temperature;

d. placing said plurality of sonic transducers at a level which is substantially in the plane of said base plate, and in spaced locations around the circumference of the tank;

e. heating said chemical solvent to a temperature between 120 degrees Fahrenheit and 220 degrees Fahrenheit at a location outside of said steam generator;

f. at least partially filling the tank with said chemical solvent, so as to establish an initial level which is only a few inches above the level of said base plate;

g. activating said sonic transducers to frequencies in the range of about 2 KHZ to 200 KHZ so that sonic energy is transmitted through said chemical solvent and into said sludge pile whereby cavitation induced at said base plate by said sonic energy cooperates with said chemical solvent so as to enhance and accelerate the removal of said sludge pile from said base plate;

h. continuing the cooperative actions of said hot chemical solvent and said transducers upon said base plate for several hours until the sludge pile is removed from said base plate; and i. flushing said steam generator with a liquid to remove said sludge pile from said steam generator.

9. In the art of maintaining a steam generator for a nuclear power plant in which the steam generator is characterized by an enclosed tank containing a plurality of heat exchanger tubes and a plurality of support plates arranged transverse to and sequentially spaced along the longitudinal axes of the tubes and forming junctions therewith, where crevices exist between the heat exchanger tubes and the support plates at the site of the junctions, the junctions being thereby arranged in a series of groups, and also containing an outer shell and a metal wrapper inside the tank which envelopes the plurality of tubes and support plates, and wherein magnetite tends to build up within the crevices at the junctions over a period of time, the process of removing the magnetite from the crevices and the junctions while the heat exchanger tubes and support plates remain in their operative positions inside the steam generator, comprising the steps of:

a. selecting a chemical solvent which when heated to a temperature between 120 degrees Fahrenheit and 220 degrees Fahrenheit dissolves magnetite exposed to fresh chemicals at a rate equal to or greater than about 1.0 inch per 24 hours;

b. at least partially filling the tank with said chemical solvent, so as to establish an initial level which is only a few inches above the level of the uppermost group of junctions and their uppermost group of crevices;

c. adding a metal corrosion inhibitor to said chemical solvent;

d. selecting a high boiling point fluid and placing the fluid in a plurality of thin flexible containers, wherein the combination of fluid and the thin flexible container has the same acoustic impedance as said metal wrapper;

e. placing said plurality of high boiling point fluid filled containers at a level which is below the surface of said chemical solvent, substantially in the plane of said uppermost group of junctions and uppermost group of crevices and in spaced locations around the circumference of and in contact with said metal wrapper;

f. selecting a plurality of sonic transducers wherein each sonic transducer has a power output greater than about 0.2 watts per square centimeter at room temperature;

g. placing said plurality of sonic transducers in alignment with and in contact with corresponding ones of said plurality of high boiling point fluid filled containers and also in contact with said metal wrapper;

h. running a hot fluid through said heat exchanger tubes so that the chemical solvent in the region adjacent said junctions and crevices reaches a temperature between 120 degrees Fahrenheit and 220 degrees Fahrenheit;

i. activating said sonic transducers to a frequency in the range of about 2 KHZ to 200 KHZ so that sonic energy is transmitted through said fluid filled containers, through said metal wrapper and through said chemical solvent, and to said junctions and into and laterally of said crevices whereby cavitation induced at said junctions and at said crevices by said sonic energy cooperates with said chemical solvent so as to enhance and accelerate the removal of the magnetite from said junctions and crevices;

j. continuing the cooperative action of said hot chemical solvent and said transducers upon said uppermost group of junctions and crevices until the magnetite is removed from the junctions and crevices;

k. then lowering the level of said chemical solvent to a height which is only a few inches above the next group of junctions and crevices from which magnetite is to be removed, lowering said plurality of high boiling point fluid filled containers and said plurality of transducers to a corresponding lower location on said metal wrapper in a plane substantially in alignment with said next group of junctions and crevices, and again applying said cooperative effort between said hot chemical solvent and said transducers until the magnetite is removed from said next group of junctions and next group of crevices; and l. continuing in this fashion at the level of each successive group of junctions and crevices until all of said junctions and crevices have been cleaned.

10. The process as defined in claim 9 wherein said high boiling point fluid is oil and said container is a thin plastic bag.

11. The process as defined in claim 9 wherein said chemical solvent is heated to a temperature between 120 degrees Fahrenheit and 220 degrees Fahrenheit at a location outside said steam generator before it is placed into said steam generator as described.

12. In the art of maintaining a steam generator for a nuclear power plant in which the steam generator is characterized by an enclosed tank containing a plurality of heat exchanger tubes and a plurality of support plates arranged transverse to and sequentially spaced along the longitudinal axes of the tubes and forming junctions therewith, where crevices exist between the heat exchanger tubes and the support plates at the site of the junctions, the junctions being thereby arranged in a series of groups, and also containing an outer shell and a metal wrapper inside the tank which envelops the plurality of tubes and support plates, and wherein magnetite tends to build up within the crevices at the junctions over a period of time, the process of removing the magnetite from the crevices and the junctions while the heat exchanger tubes and support plates remain in their operative positions inside the steam generator, comprising the steps of:

a. cutting a plurality of windows in said metal wrapper such that a number of the windows are substantially in the plane of each group of junctions and in spaced locations around the circumference of and in contact with said metal wrapper;

b. selecting a plurality of sonic transducers wherein each sonic transducer has a power output greater than about 0.2 watts per square centimeter at room temperature;

c. placing said plurality of sonic transducers at a level which is substantially in the plane of each group of junctions, in spaced locations around and in contact with the circumference of said metal wrapper, and substantially in alignment with corresponding ones of said plurality of windows;

d. at least partially filling the tank with said chemical solvent so as to establish a level which is only a few inches above the level of the uppermost group of junctions;

e. adding a metal corrosion inhibitor to said chemical solvent;

f. running a hot fluid through said heat exchanger tubes so that the chemical solvent in the region adjacent said junctions reaches a temperature between 120 degrees Fahrenheit and 220 degrees Fahrenheit;

g. activating all the transducers simultaneously at each level substantially in the plane of each group of junctions and each group of crevices to a frequency in the range of about 2 KHZ to 200 KHZ so that sonic energy is transmitted through said chemical solvent to each group of junctions and into and laterally of each group of crevices whereby cavitation induced at each group of junctions and each group of crevices cooperates with said chemical solvent so as to enhance and accelerate the removal of the magnetite from all of the junctions and crevices;

h. continuing the cooperative action of said hot chemical solvent and said transducers upon each group of junctions and crevices until the magnetite is removed from all of the junctions and all of the crevices.

13. The process as defined in claim 12 wherein said plurality of windows are each slightly smaller than the face of said transducers.

14. The process as defined in claim 12 wherein said plurality of windows are each slightly larger than the face of said transducer so that a portion of each transducer may protrude through said wrapper.

15. The process as defined in claim 12 wherein said chemical solvent is heated to a temperature between 120 degrees Fahrenheit and 220 degrees Fahrenheit before it is placed into the steam generator as described.

* * * * *